US007207337B2

(12) United States Patent
Park

(10) Patent No.: US 7,207,337 B2
(45) Date of Patent: Apr. 24, 2007

(54) EYELASH CURLER

(75) Inventor: Il-Yong Park, Seoul (KR)

(73) Assignee: Shinwoo Union Co., Ltd., Seoul (KR)

( * ) Notice: Subject to any disclaimer, the term of this patent is extended or adjusted under 35 U.S.C. 154(b) by 415 days.

(21) Appl. No.: 10/807,059

(22) Filed: Mar. 23, 2004

(65) Prior Publication Data

US 2005/0061347 A1 Mar. 24, 2005

(30) Foreign Application Priority Data

Sep. 22, 2003 (KR) ..... 20-2003-0029959

(51) Int. Cl.
*A45D 2/48* (2006.01)

(52) U.S. Cl. ..... 132/217

(58) Field of Classification Search ..... 132/216, 132/217, 213, 214
See application file for complete search history.

(56) References Cited

U.S. PATENT DOCUMENTS 5,524,649 A * 6/1996 Suh ..... 132/217
5,685,324 A * 11/1997 Huang ..... 132/217
5,960,799 A * 10/1999 Suh ..... 132/217
2004/0020505 A1* 2/2004 Sugiyama ..... 132/217

FOREIGN PATENT DOCUMENTS

| | | | |
|---|---|---|---|
| JP | 2000-116429 | * | 4/2000 |
| KR | 96-33362 | | 11/1996 |
| KR | 20-0181060 | | 11/1999 |

* cited by examiner

*Primary Examiner*—Todd E. Manahan
*Assistant Examiner*—Rachel A. Running
(74) *Attorney, Agent, or Firm*—The Webb Law Firm

(57) ABSTRACT

An eyelash curler composed of a main body, having an upper body part; a lower body part having a curved forming space at a front section thereof, to allow eyelashes of the user to be positioned therein, the lower body part constituting a handle grip body with the upper body part; an immobilizing member provided at a front end of the lower body part and curved to correspond to curvature of an eyelash line shape; a forming member coupled to the immobilizing member and made of a metal sheet having the same curvature as that of the immobilizing member; and a pressing member disposed between the upper and lower body parts, which includes a pressing plate; a pressing part integrally connected to a front end of the pressing plate through a boundary part; and an elastically pressing part coupled to a front end of the pressing part.

6 Claims, 4 Drawing Sheets

EYELASH CURLER

BACKGROUND OF THE INVENTION

1. Field of the Invention

The present invention pertains, in general, to eyelash curlers, and more specifically, to an eyelash curler, characterized in that a forming member, which is coupled to an immobilizing member curved to correspond with the curvature of an eyelash line shape of a user, is provided with a metal sheet, and the metal sheet further has a coat layer of a urethane or rubber based resin thereon, thereby providing an advantageous effect of the simple push-button structure made of plastic and also providing good curling performance of the metal sheet.

2. Description of the Related Art

In general, an eyelash curler is a tool for use in upwardly curling eyelashes of a user in order, in which the eyelashes are positioned in a forming space in the front of a handle of the eyelash curler, and then pulled upwards while being slightly pressed by a pressing member. Such a curling process is repeated two or three times, thereby obtaining desirably formed eyelashes.

To enhance a person's beauty, various eyelash curlers have been suggested for many years. Among the curlers, several curlers are described, below.

In Korean Utility Model Laid-open Publication No. 96-33362, there is disclosed an eyelash curler, in which an immobilizing member having an eyelash line shape is positioned at an utmost end of the curler, and extension rods extends from both ends of the immobilizing member and are integrally connected to an immobilized gripping part. Further, a pressing rod, which is provided to be in contact with the immobilizing member, is integrally connected to a movable gripping part through a connecting rod to be moved in the extension rods of the immobilizing member. Furthermore, a coil spring is mounted between the pressing rod and the movable gripping part, and simultaneously, bendable parts, which are provided to both the gripping parts, are formed to correspond to each other. Also, a ring made of a synthetic resin is mounted in a finger loop of each gripping part, and a pre-silicone case is removably attached to the gripping parts.

The above eyelash curler is characterized in that upper and lower pressing parts are spaced at a regular interval by the coil spring even in the state of being unused, and thus, the eyelashes of the user can be easily pulled and curled by use of the gripping parts.

However, as for the above eyelash curler, since all constitutive parts, including a forming member, a main body, a handle, etc., are made of a metal, when the forming member provided to the immobilizing member comes into contact around the eyelashes of the user, the user may have cool or foreign sensation. Further, when terminating ends of the extension rods of the immobilizing member come into contact with the upper portion of the eyelashes, the user may also be inconvenienced or may have discomfort.

In particular, since the movable gripping part relative to the immobilized gripping part is provided in a scissor shape, when the eyelashes are held between the pressing rod and the immobilizing member according to the movement of the pressing rod toward the immobilizing member, the user should move her fingers as in a scissoring manner. In this case, the eyelash curler per se may be severely shaken, and the user cannot hold her eyelashes without assistance. Therefore, such an eyelash curler is used by a beautician or make-up artist to curl the eyelashes of clients.

To solve the above problems, Korean Utility Model Registration No. 181060 proposes an eyelash curler, including a pressing member and a pressing plate connected to a pressing part, in which the pressing part made of a bendable wire is rotatably fitted into the rear of the pressing member and the pressing plate.

As for the above eyelash curler, an immobilizing member and the pressing member in the front of a handle, are made of plastics, and the eyelash curler is stably operated without shaking upon moving the pressing member. Hence, when the eyelashes are curled, the user can simply curl her eyelashes without assistance while not being cool or foreign to the touch. In addition, both sides of the pressing member are pressed, whereby the eyelashes are desirably curled. In such cases, the pressing plate and the pressing part are not damaged, and thus, the eyelash curler can be utilized for longer periods.

However, the above eyelash curler is disadvantageous in that when the eyelashes of the user are curled while bringing the upper and lower portions of the eyelashes into contact with the plastic of the forming member and the flat or convex silicon pad, respectively, they may be cut or folded by the forming member. This is because the forming member obtained by an injection molding process has too sharp an edge when used initially. Also, the plastic of the forming member easily becomes blunt over time, and thus, the eyelashes are not partially curled or shaped.

SUMMARY OF THE INVENTION

Therefore, it is an object of the present invention to alleviate the problems encountered in the related art and to provide an eyelash curler made of plastics, characterized in that a forming member coupled to an immobilizing member having an eyelash line shape is provided with a metal sheet, and the metal sheet further includes a coat layer of a urethane or rubber based resin thereon, thereby simultaneously realizing curling functions of the metal and the plastic applied to the curler with a simple push-button structure. Hence, even though a curling process is performed by an excessive force of the user, the eyelashes are not folded or cut by the elasticity of the coat layer coated onto the metal sheet.

To achieve the above object of the present invention, there is provided an eyelash curler comprising: a body part made of plastic including a curved forming space at a front section thereof, to allow eyelashes of a user to be positioned therein, a handle grip body, an immobilizing member provided at a front end of the body part and curved to correspond to curvature of an eyelash line shape of the user and a pair of guide grooves; a forming member coupled to the immobilizing member and made of a metal sheet having the same curvature as that of the immobilizing member; and a pressing member made of plastic including a pressing plate which is rotatably supported to the body part by a pin formed on a rear end thereof and is biased by an elastic element, a pressing part integrally connected to a front end of the pressing plate through a boundary part, to be moved along the guide grooves, and an elastically pressing part coupled to a front end of the pressing part.

Further, the body part consists of an upper body part and a lower body part; the guide grooves are formed at a front section of the upper body part; and the immobilizing member is provided at a front end of the lower body.

Preferably, a pair of coupling bosses are formed at a front end of the upper body part, a pair of coupling holes are formed on both sides of the immobilizing member, and the forming member is coupled to the immobilizing member by coupling the coupling bosses with the coupling holes.

Preferably, the pressing member is disposed between the upper and the lower body parts.

Further, the metal sheet, which comes into contact with an upper surface of the pressing part, has a smooth surface without burrs, and is made of stainless steel to attain rust resistance. In addition, the metal sheet is made of wrought steel requiring a plating process by use of nickel, chromium or gold.

In addition, the metal sheet has a coat layer of a urethane or rubber based resin thereon. Such a coat layer functions to allow the user not to be cool or foreign to the touch upon bringing the forming member into contact with the upper portion of the eyelashes of the user. The coat layer has a thickness of 20–200 μm, and preferably, 60–100 μm, so as to allow the eyelashes not to be folded or cut.

Also, the elastically pressing part of the pressing member comprises a front portion protruded upward and downward, a rear portion coupled to the front end of the pressing part, and a protuberance forward projecting from a lower protrusion of the front portion thereof, so that the eyelashes of the user, held between the forming member and the elastically pressing part, are upwardly curled.

Moreover, a plurality of gripping recesses, which are ergonomically designed to enable a user to stably grip the handle grip body, are provided at both side surfaces of the handle grip body of the eyelash curler.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a detailed description will be given of an eyelash curler of the present invention, with reference to the appended drawings.

Figure 1:
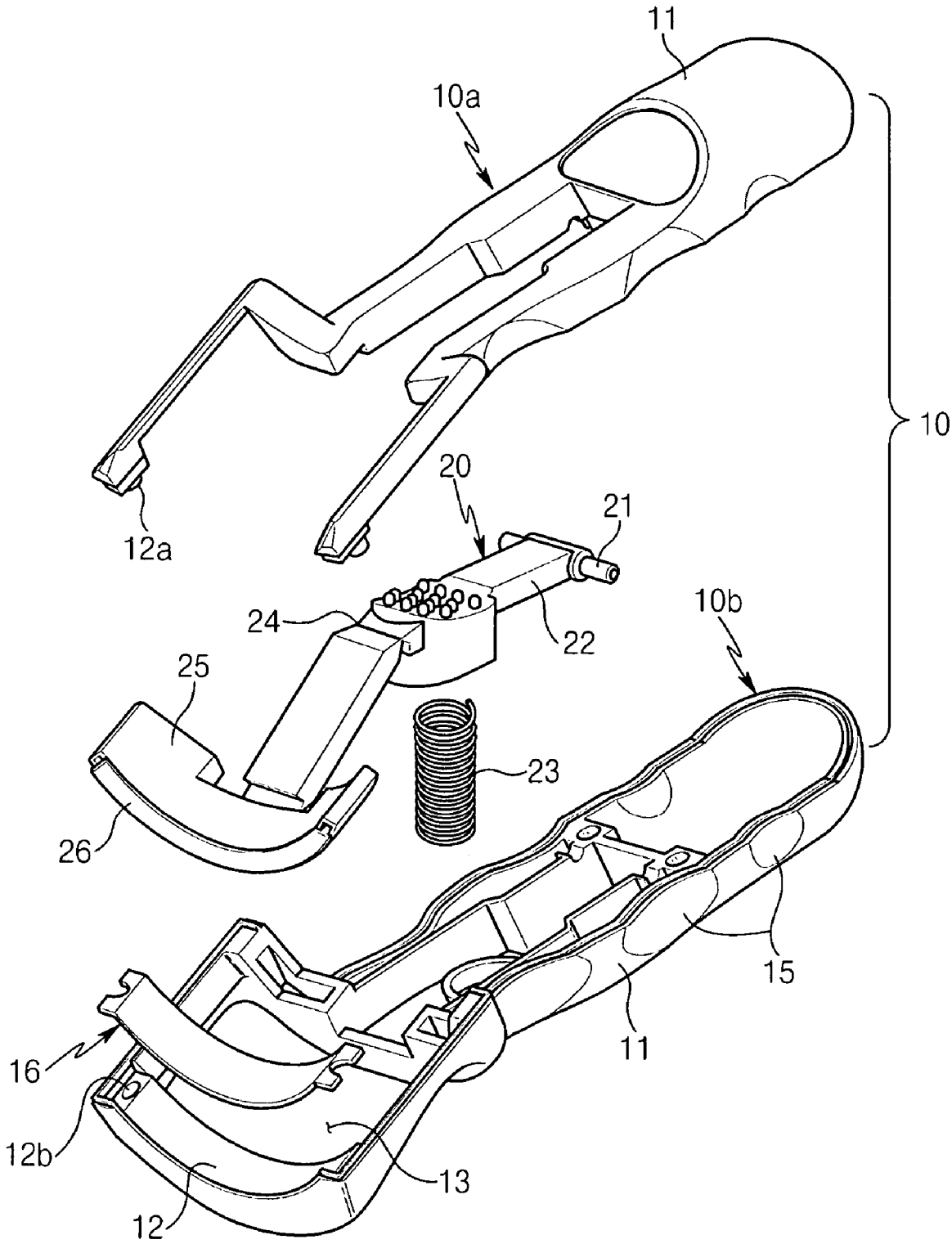
FIG. 1 is an exploded perspective view of an eyelash curler, according to a first embodiment of the present invention.
Figure 2:
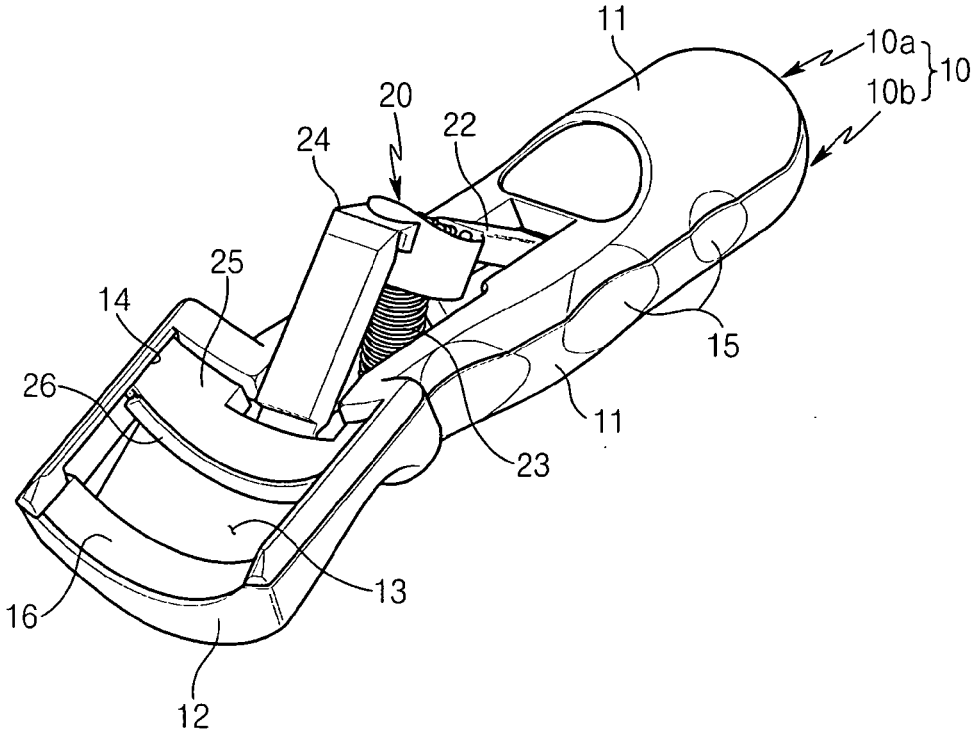
FIG. 2 is a perspective view of the eyelash curler, according to the first embodiment of the present invention.
Figure 3:
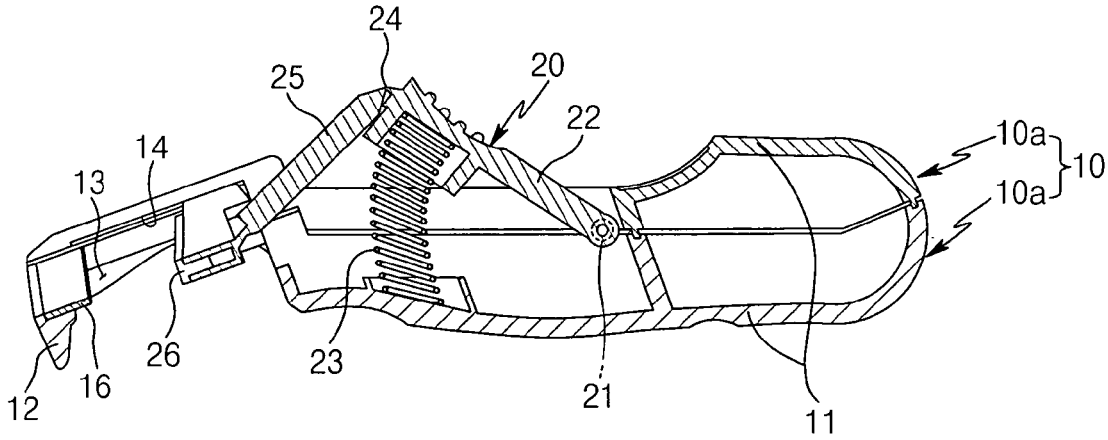
FIG. 3 is a sectional view of the eyelash curler of FIG. 2.

FIG. 1 is an exploded perspective view of an eyelash curler, according to a first embodiment of the present invention, and FIGS. 2 and 3 is a perspective view and a sectional view of the eyelash curler, according to the first embodiment of the present invention, respectively, which is in an assembled state.

As shown in the above drawings, an eyelash curler is comprised of a curler main body 10, which includes an upper body part 10*a* and a lower body part 10*b* both of which constitute a handle grip body 11 thereof, and an immobilizing member 12 provided at a front end of the lower body part 10*b* and curved to correspond with the curvature of the eye and eyelash of the user. Further, the curler main body 10 has two extension pieces extended from both sides of a front end of the upper body part 10*a*, and a forming space 13 defined by an inner surface of a front part of the lower body part 10*b*, the curved immobilizing member 12, and the pair of extension pieces, to allow the eyelashes of the user to be positioned therein. Furthermore, a guide groove 14 is longitudinally formed at a lower surface of each extension piece and extended therealong. Also, a pair of coupling bosses 12*a* are protruded from lower surfaces of the front ends of the extension pieces, and a pair of coupling holes 12*b* are provided at both sides of the immobilizing member 12, so that opposite ends of a forming member 16 are correctly set to the immobilizing member 12. A plurality of gripping recesses 15, which are ergonomically designed to enable a user to stably grip the handle grip body 11, are formed at side surfaces of the handle grip body 11.

In addition, the eyelash curler of the present invention includes a pressing member 20. Such a pressing member 20, having a pressing plate 22 and a pressing part 25, is provided between the upper body part 10*a* and the lower body part 10*b* of the curler main body 10. In such cases, the pressing plate 22 of the pressing member 20 is swingably mounted to the curler main body 10 in such a way that a pair of shaft pins 21, which are provided at both sides of a rear end of the pressing member 20, are rotatably supported between the upper and lower bodies 10*a* and 19*b*. A spring 23 is disposed between the pressing member 20 and the lower body part 10*b* to bias the pressing member 20 upward. Also, the pressing part 25 is integrally connected to the front end of the pressing plate 22 through a flexible boundary part 24, and hence, is angled through the boundary part 24 while being moved along the guide grooves 14.

That is, the pressing plate 22 is rotated downward about the shaft pins 21. At this point, the pressing part 25 connected to the pressing plate 22 is moved toward the immobilizing member 12 in the front of the forming space 13 by the downward movement of the pressing plate 22, and thus, comes into close contact with the immobilizing member 12.

In addition, an elastically pressing part 26 made of silicone is fitted into a front end of the pressing part 25, in which the elastically pressing part 26 has a front portion and a rear portion. The front portion is protruded upward and downward, and the rear portion is fitted into the pressing part 25.

Figure 4:
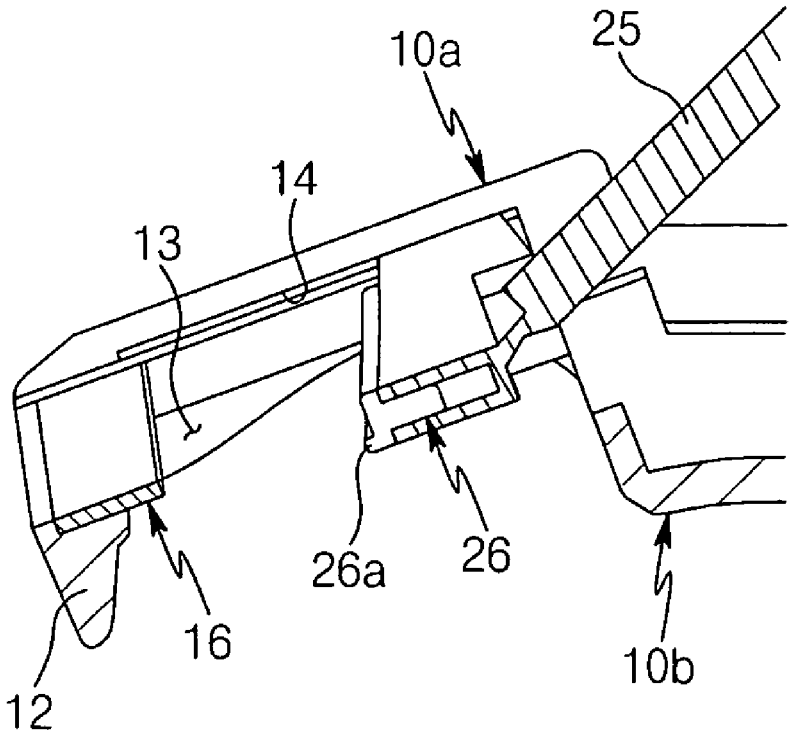
FIG. 4 is a sectional view of an elastically pressing part, as a main constitutive part of the eyelash curler of FIG. 2.

Further, as shown in FIG. 4, the elastically pressing part 26 may include a protuberance 26*a*, which projects from a lower protrusion of the front portion thereof. Such a protuberance 26*a* of the elastically pressing part 26 functions to cause the eyelashes of the user held between the forming member 16 coupled to the immobilizing member 12 and the elastically pressing part 26 of the pressing member 20 to be upwardly curled, thereby obtaining desired curling effects.

Figure 5A:
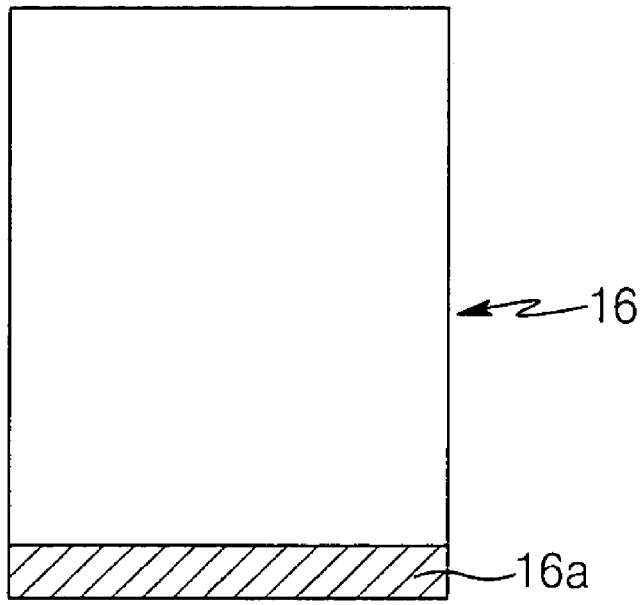
FIG. 5*a* is a sectional view of a forming member, as a main constitutive part of the eyelash curler of FIG. 2.

Meanwhile, the immobilizing member 12 is equipped with the forming member 16. As such, the opposite ends of the forming member 16 are set to the immobilizing member 12 by the pair of the coupling bosses 12*a* of the extension pieces and the pair of the coupling holes 12*b* provided at the opposite ends of the immobilizing member 12. The forming member 16, as in FIG. 5, is provided with a metal sheet 16*a* that is curved to correspond to the inner curved surface of the immobilizing member 12, in which the metal sheet 16*a* should be very smooth with no burrs at its rear end surface that comes into contact with the upper surface of the pressing part 25. Although, the metal sheet 16*a* is preferably made of stainless steel to have rust resistance, it may be formed of inexpensive wrought steel.

In the cases where the forming member 16 is produced by the metal sheet 16*a* made of wrought steel, it is preferred that a plating process using nickel, chromium or gold is performed to attain rust resistance of the metal sheet 16*a*.

Figure 5B:
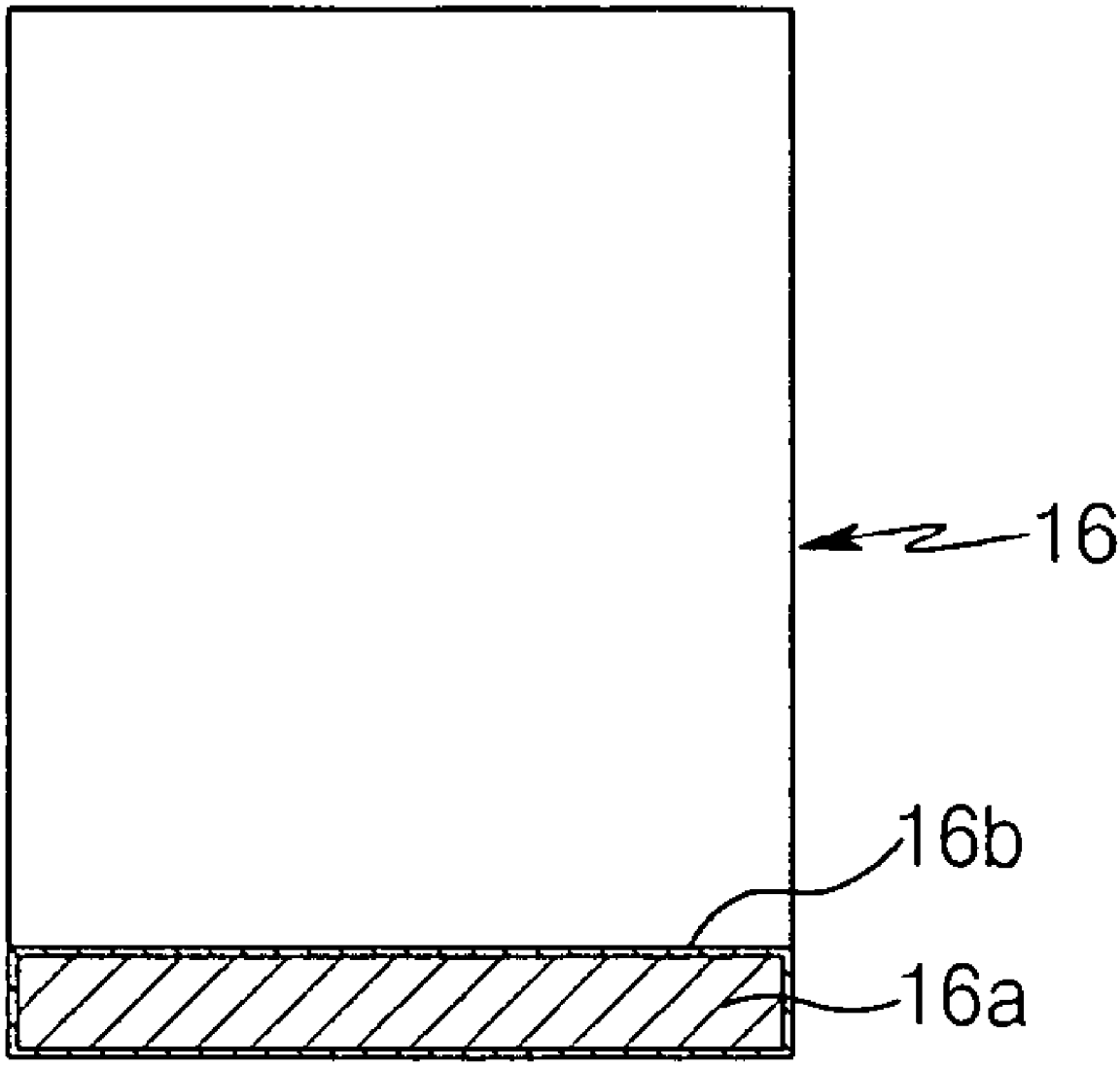
FIG. 5*b* is a sectional view of a forming member, as a main constitutive part of an eyelash curler according to a second embodiment of the present invention.

As for a forming member 16 of an eyelash curler according to a second embodiment of the present invention, shown in FIG. 5*b*, a metal sheet 16*a* of the forming member 16 may have a coat layer 16*b* of a urethane or rubber based resin thereon. As such, the coat layer 16*b* acts to provide no cool or foreign to the touch to the user upon bringing the forming member 16*b* into contact with the upper portions of the eyelashes, and to allow the eyelashes not to be folded or cut upon curling.

The coat layer 16*b* has a thickness to the extent of the eyelashes being not folded or cut while the user may not be cool or foreign to the touch upon bringing the forming member 16 into contact with her eyelashes. Accordingly, the coat layer 16*b* is coated at a thickness of 20–200 μm, and preferably, 60–100 μm.

The structured eyelash curler of the present invention is applied practically as follows.

The immobilizing member 12 of the curler main body 10 comes in contact with upper portions of the eyelashes of the user, while the eyelashes are positioned in the forming space 13 of the curler main body 10. Then, when the pressing plate 22 of the pressing member 20 is pressed down, the pressing member 20 is rotated downward about the shaft pins 21 which are fitted into the handle grip body 11. Thereby, the pressing part 25, which is connected to the front end of the pressing plate 22 through the boundary part 24, is guided forward along the guide grooves 14, and thus, moved toward the immobilizing member 12 in the front of the forming space 13.

After the completion of the forward movement of the pressing part 25, the pressing part 25 is in close contact with the immobilizing member 12. In this case, the eyelashes are held between the forming member 16 coupled to the immobilizing member 12 and the elastically pressing part 26 on the pressing part 25. Thereafter, the curler main body 10 is pulled while the handle grip body 11 is lifted up. Thereby, the eyelashes are desirably curled upwards while being released from the eyelash curler of the present invention.

Meanwhile, since the forming member 16 is provided with the metal sheet 16*a* which has a smooth surface by removing burrs caused by the cutting process of the metal sheet 16*a* through a sanding treatment, the curling of the eyelashes of the user can be efficiently performed.

The above curling procedure is repeated two or three times, whereby the curling of the eyelashes is completed.

Moreover, as shown in FIG. 5*b*, the surface of the metal sheet 16*a* of the forming member 16, which is subjected to sanding treatment, is entirely coated with the coat layer 16*b* having elasticity. Therefore, even though the curling process is performed by an excessive force of the user, the eyelashes are not folded or cut by the elasticity of the coat layer 16*b* coated onto the metal sheet 16*a*.

As described hereinbefore, the present invention provides a plastic-made eyelash curler, characterized in that a forming member coupled to an immobilizing member of the eyelash curler is provided with a metal sheet, and the metal sheet further has a coat layer of a urethane or rubber based resin thereon, thereby simultaneously realizing curling functions of the metal and the plastic applied to the curler with a simple push-button structure. Thus, even though a curling process is performed by an excessive force of the user, the eyelashes are not folded or cut by the elasticity of the coat layer coated onto the metal sheet.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An eyelash curler comprising:

a body part made of plastic including a curved forming space at a front section thereof, to allow eyelashes of a user to be positioned therein, a handle grip body, an immobilizing member provided at a front end of the body part and curved to correspond to curvature of an eyelash line shape of the user and a pair of guide grooves;

a forming member coupled to the immobilizing member and made of a metal sheet having the same curvature as that of the immobilizing member; and a pressing member made of plastic including a pressing plate which is rotatably supported to the body part by a pin formed on a rear end thereof and is biased by an elastic element, a pressing part integrally connected to a front end of the pressing plate through a boundary part, to be moved along the guide grooves, and an elastically pressing part coupled to a front end of the pressing part;

wherein the body part can be separated into an upper body part and a lower body part; and the guide grooves are formed at a front section of the upper body part and the immobilizing member is provided at a front end of the lower body part; and wherein a pair of coupling bosses are formed at a front end of the upper body part; and a pair of coupling holes are formed on both sides of the immobilizing member and the forming member is coupled to the immobilizing member by coupling the coupling bosses with the coupling holes.

2. The eyelash curler as defined in claim 1, wherein the pressing member is disposed between the upper and the lower body parts.

3. The eyelash curler as defined in claim 1, wherein the metal sheet of the forming member is made of stainless steel, or wrought steel requiring a plating process by use of nickel, chromium or gold.

4. The eyelash curler as defined in claim 1, wherein the metal sheet of the forming member has a coat layer of a urethane or rubber based resin thereon.

5. The eyelash curler as defined in claim 4, wherein the coat layer is 20–200 μm thick.

6. The eyelash curler as defined in claim 1, wherein the elastically pressing part comprises a front portion protruded upward and downward, a rear portion coupled to the front end of the pressing part, and a protuberance forward projecting from a lower protrusion of the front portion thereof.

* * * * *